US007017786B2

(12) United States Patent
Ho

(10) Patent No.: US 7,017,786 B2
(45) Date of Patent: Mar. 28, 2006

(54) IRONING DEVICE FOR TREATING FRONT TOP PART OF TROUSERS

(76) Inventor: Myong H Ho, 356 Warren Blvd., Broomall, PA (US) 19008

( * ) Notice: Subject to any disclaimer, the term of this patent is extended or adjusted under 35 U.S.C. 154(b) by 0 days.

(21) Appl. No.: 11/022,660

(22) Filed: Dec. 28, 2004

(65) Prior Publication Data

US 2005/0150918 A1 Jul. 14, 2005

(30) Foreign Application Priority Data

Jan. 13, 2004 (KR) ..... 2004-883

(51) Int. Cl.
*D06F 71/28* (2006.01)

(52) U.S. Cl. ..... 223/73

(58) Field of Classification Search ..... 223/57, 223/66–74; 38/14, 16, 71
See application file for complete search history.

(56) References Cited

U.S. PATENT DOCUMENTS 2,723,062 A * 11/1955 Rosenthal ..... 223/73
2,956,714 A * 10/1960 Rosenthal et al. ..... 223/74
3,525,459 A * 8/1970 Buckley et al. ..... 223/73
3,567,083 A * 3/1971 Piilola ..... 223/73
6,792,705 B1 * 9/2004 Cartabbia ..... 38/12
6,805,268 B1 * 10/2004 Cartabbia ..... 223/57

* cited by examiner

*Primary Examiner*—Ismael Izaguirre
(74) *Attorney, Agent, or Firm*—Robert E. Bushnell, Esq.

(57) ABSTRACT

An ironing device for treating creases in a front top part of trousers by pressing the trousers using movable iron plates, which are movable by pneumatic pistons. The trousers are fixed onto a body including a trouser fixing part formed below a front protrusion of an upper supporter. Front and rear supporting members are formed at both sides of the protrusion, for supporting arms of the iron plates. The arms include vertical and horizontal portions coupled to each other and where the pneumatic pistons are each coupled perpendicularly to an end of the vertical arms and to a bottom surface of the iron plates. The iron plate applies a pressing force to the trousers perpendicularly to the front surface of the trousers without being rotated or slid with respect to the trousers, so the ironing device forms clear creases in the trousers, with a simple structure and reduced power consumption.

6 Claims, 6 Drawing Sheets

IRONING DEVICE FOR TREATING FRONT TOP PART OF TROUSERS

CLAIM OF PRIORITY

This application makes reference to, incorporates the same herein, and claims all benefits accruing under 35 U.S.C. §119 from an application earlier filed in the Korean Intellectual Property Office on 13 Jan. 2004 and there duly assigned Serial No. 2004-883.

BACKGROUND OF THE INVENTION

1. Field of the invention

The present invention relates to an ironing device capable of treating creases formed in a front top part of trousers by pressing the front top part of trousers using iron plates while longitudinally fixing the trousers, and more particularly to an ironing device capable of creating clear creases in a front top part of trousers by moving iron plates installed at arms of the ironing device in such a manner that the iron plates uniformly apply pressing force over the whole area of the creases formed in the front top part of trousers.

2. Description of the Prior Art

As generally known in the art, a conventional ironing device for creating clear creases in a front top part of trousers includes a stand-type body and a trouser fixing member, which is vertically installed at an upper portion of the body and sprays steam to an exterior. In addition, arms are installed at both sides of the body in such a manner that the arms rotatably moved by means of a cylinder. Iron plates are installed at ends of the arms. In such a conventional ironing device having the above construction, the trouser fixing member sprays steam onto trousers fixed by the trouser fixing member, and the iron plates heated by a heating unit apply pressing force to the creases formed in the front top part of trousers, thereby making the clear creases in the front top part of the trousers. I have discovered that a pneumatic cylinder which is used to apply a substantial force to create these creases may subject the structure of the ironing device to overload, so not only is life span of the ironing device shortened, but also great power consumption may occur.

SUMMARY OF THE INVENTION

Accordingly, the present invention has been made to solve the above-mentioned problems occurring in the prior art, and an object of the present invention is to provide an ironing device for a front top part of trousers, capable of precisely and strongly pressing the front top part of the trousers by simply constructing arms, to which iron plates are attached, and installing a pneumatic cylinder between arms and iron plates in such a manner that the iron plates provided at end portions of the arms perpendicularly make contact with a trouser fixing member.

To accomplish the above object, according to the present invention, there is provided an ironing device for treating a front top part of trousers, the ironing device comprising: a body including a trouser fixing member formed below a front protrusion of an upper supporter and an iron plate, which is movable towards the trouser fixing member in such a manner that the iron plate makes contact with the trousers while applying steam or heat to the trousers so as to create clear creases in the front top part of the trousers; front and rear supporting members formed at both sides of the front protrusion; an arm including a vertical arm and a horizontal arm coupled to the vertical arm at a right angle and horizontally installed in the front and rear supporting members; and a first pneumatic cylinder coupled perpendicularly to an end of the vertical arm and having a rod coupled perpendicularly to a bottom surface of the iron plate so as to move the iron plate in front and rear directions.

According to the preferred embodiment of the present invention, upper portions of the front and rear supporting members are opened, the rear supporting member rotatably supports an end portion of the horizontal arm, and a second pneumatic cylinder coupled to a side of the body is connected to the horizontal arm.

According to the preferred embodiment of the present invention, a steam sprayed from a steam spraying section passes through an ozone generator or a perfume generator in the body of the ironing device so as to contain ozone or perfume therein.

According to the preferred embodiment of the present invention, a fixing table, which is movable up and down, is provided at a lower portion of the body in order to fix a lower end portion of the trousers thereto.

According to the preferred embodiment of the present invention, a rear pressing plate and a second pneumatic cylinder are provided rearward of the trouser fixing member so as to apply pressing force to a rear top part of the trousers.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
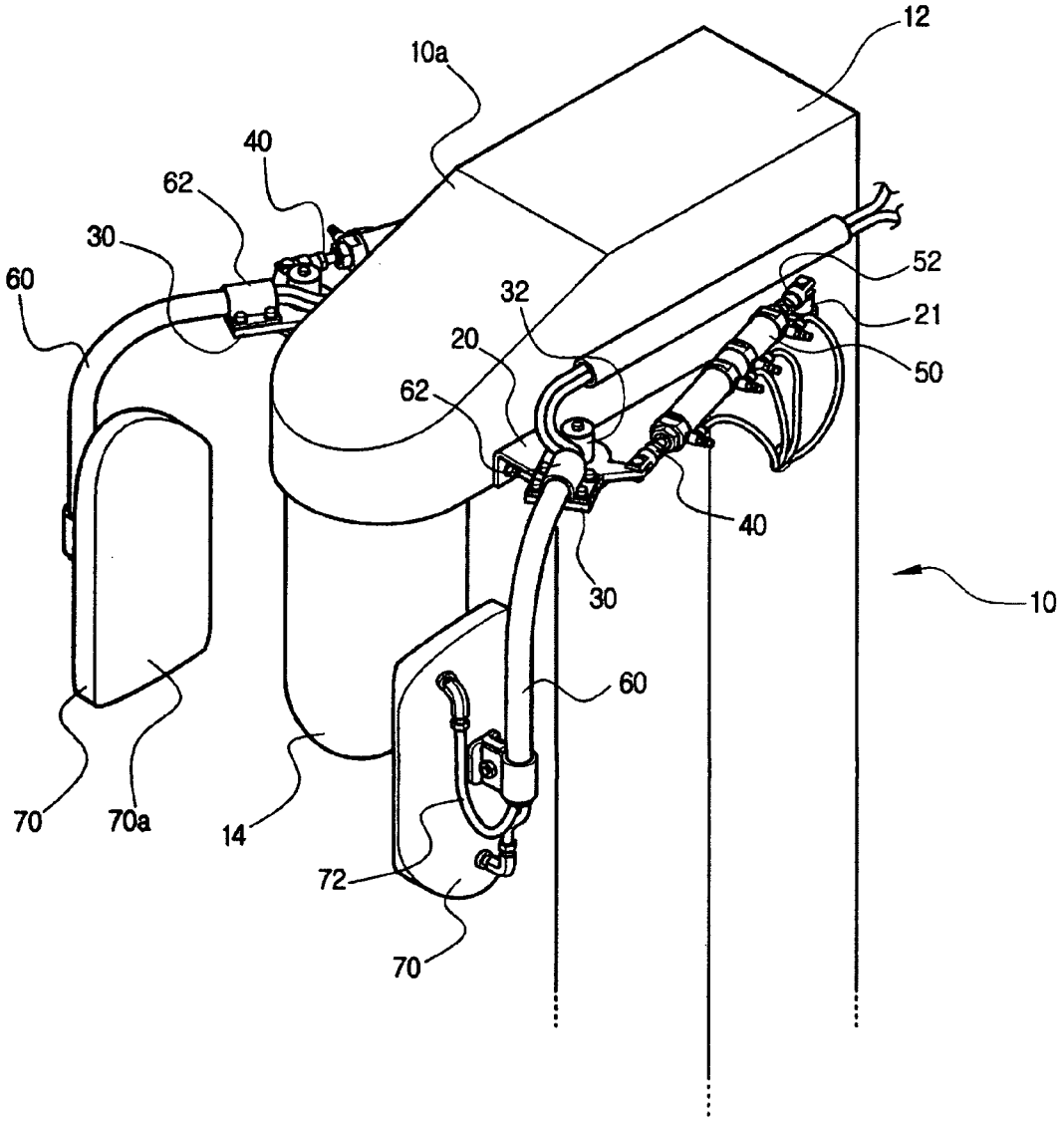
FIG. 1 (PRIOR ART)
FIG. 1 is a perspective view showing a conventional ironing device for a front top part of trousers.

FIG. 1 shows a conventional ironing device for treating a front top part of trousers. As shown in FIG. 1, the conventional ironing device includes arms 60 provided at end portions thereof with iron plates 70 for pressing the trousers. Upper end portions of the arms 60 are installed on upper surfaces of rotating plates 30, which are rotatably mounted on upper surfaces of support plates 20 installed at both lateral front portions of an upper supporter 12. As the rotating plates 30 rotate, the arms 60 are rotated together with the iron plates 70 so that arms 60 positioned at both lateral portions of the upper supporter 12 are shifted into a front center portion of the upper supporter 12. Accordingly, heating surfaces 70*a* of the iron plates 70 make contact with a curvature surface of the trouser fixing member 14 installed below a front protrusion 10*a* of the upper supporter 12.

At this time, the support plates 20 installed at both lateral front portions of the upper supporter 12 rotate the rotating plates 30 coupled to the upper end portions of the arms 60 by means of a rotating unit 32 provided at upper surfaces of the support plates 20, so that the rotating plates 30 are rotated together with the arms 60. Meanwhile, the rotating plates 30 are provided at predetermined portions thereof with connection parts connected to rods 40 of pneumatic cylinders 50. Thus, the rotating plates 30 may rotate according to the movement of the rods 40 within the pneumatic cylinder 50, thereby rotatably moving the arms 60 in a transverse direction.

In addition, since the pneumatic cylinders 50 are connected to rear support sections 21 provided at both lateral portions of the upper supporter 12, when the rods 52 move out of the pneumatic cylinders 50, reaction force may occur against the movement of rods 52. Due to such reaction force, pressure is applied to the rotating plates 30 so that pressure is transferred to the iron plates 70 installed at lower end portions of the arms 60 fixed to the rotating plates 30.

Meanwhile, the heating unit of the iron plates 70 includes steam feeding hoses 72 connected to the iron plates 70 so as to feed high-temperature steam into the iron plates 70. Such a heating unit is generally known in the art. Besides the steam feeding hoses 72, various kinds of heating units can be used for the iron plates, so the detailed description thereof will be omitted below.

However, the conventional ironing device requires a complicated structure in order to rotate the arms 60. In addition, contact pressure of the iron plates 70 with respect to the front top part of trousers may be attenuated because the iron plates 70 rotatably make contact with the front top part of trousers. For this reason, the iron plates 70 sometimes come off the trousers in the process of applying pressing force to the creases formed in the front top part of the trousers, causing a lower part of the crease to be unclear. Thus, the pneumatic cylinder 50 generates relatively great force in order to create clear creases in the front top part of trousers. In this case, the structure of the ironing device may be subject to overload, so not only is life span of the ironing device shortened, but also great power consumption may occur.

Hereinafter, a preferred embodiment of the present invention will be described with reference to the accompanying drawings.

Figure 2:
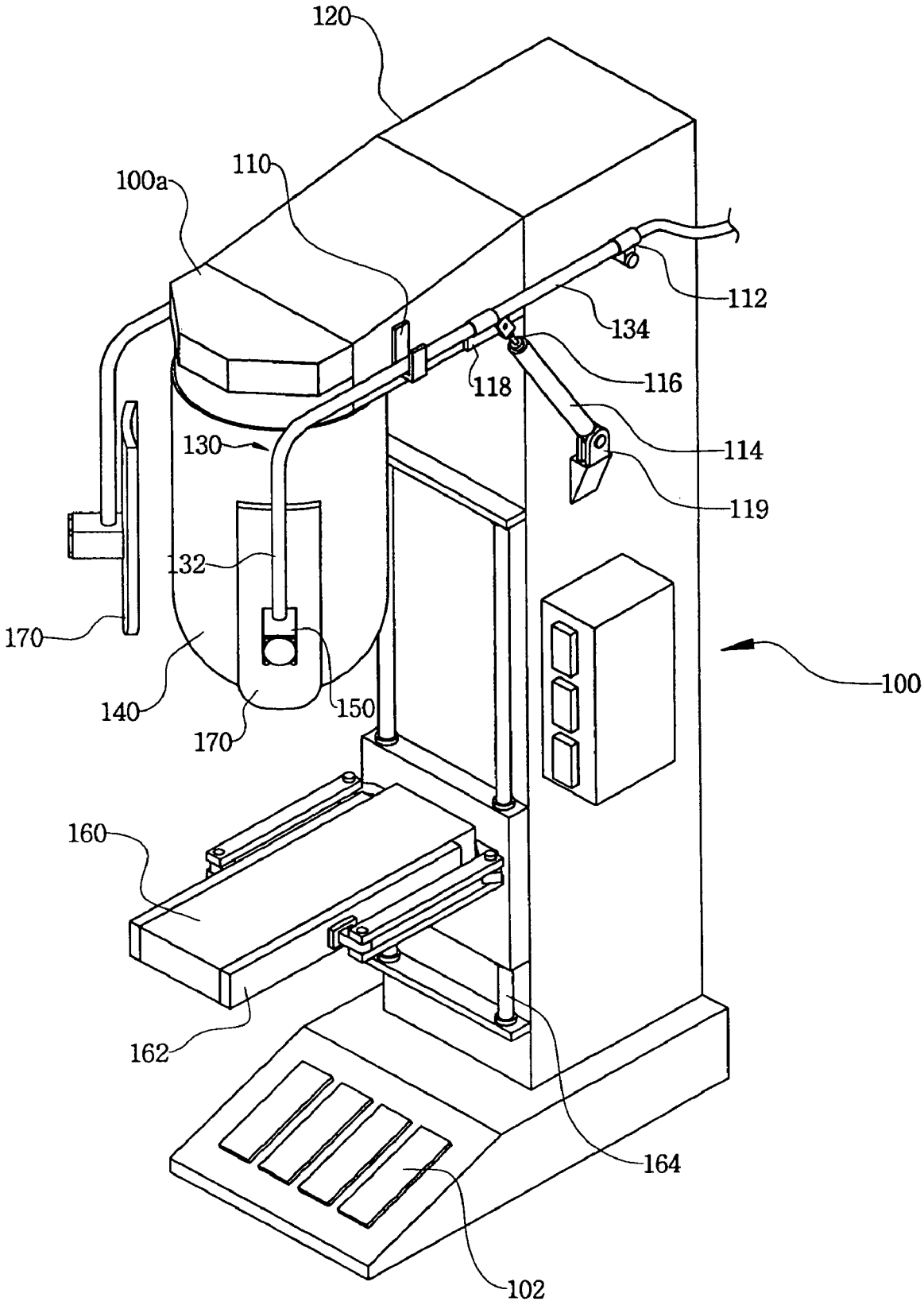
FIG. 2 is a perspective view showing an ironing device for a front top part of trousers according to one embodiment of the present invention.

FIG. 2 is a perspective view showing an ironing device for a front top part of trousers according to one embodiment of the present invention. Referring to FIG. 2, the ironing device of the present invention includes a body 100 provided at an upper portion thereof with an upper supporter 120 having a front protrusion 100*a*.

The body 100 is a stand-type body, which is vertically installed so as to perform ironing with respect to trousers while longitudinally aligning the trousers therein. Front and rear supporting members 110 and 112 are attached to both sides of the upper supporter 120 and the front protrusion 100*a*, respectively, in order to support arms 130.

Upper portions of the front supporting members 110 are opened so that the arms 130 can be separated from the front supporting members 110 through the opened upper portions of the front supporting members 110. The rear supporting members 112 has rotating shafts coupled to end portions of the arms 130. Since the arms 130 are rotatably coupled to the rear supporting members 112, the arms 130 can rotatably move about the rear supporting members 112.

Each of the arms 130 includes a vertical arm 132 and a horizontal arm 134. The horizontal arm 134 is aligned in parallel to the ground and rested in the front and rear supporting members 110 and 112. A front end of the horizontal arm 134 is downwardly bent, thereby forming the vertical arm 132. Each vertical arm 132 is coupled to each iron plate 170.

A cylindrical supporting piece 118 is attached to each horizontal arm 134 such that the cylindrical supporting piece 118 can move along the horizontal arm 134. The cylindrical supporting piece 118 is connected to a rod 116 of a pneumatic cylinder 114. Thus, as the rod 116 is moved by means of pneumatic pressure of the pneumatic cylinder 114, the horizontal arm 134 is rotatably moved.

A pneumatic cylinder 150 is coupled to a lower end of the vertical arm 132. The pneumatic cylinder 150 is aligned perpendicularly to the vertical arm 132 and extends in a horizontal direction. In addition, the pneumatic cylinder 150 is aligned perpendicularly to a bottom surface of the iron plate 170 in such a manner that the iron plates 170 horizontally approach the trouser fixing member 140.

Each of the iron plates 170 is coupled to a rod of the pneumatic cylinder 150 while forming a right angle therebetween so that the iron plates 170 horizontally make surface-contact with a surface of the trouser fixing member 140. Therefore, the iron plates 170 do not slidably move on the trouser fixing member 140, thereby securing trousers to the trouser fixing member 140 without deforming a shape of the trousers. The surface of each iron plate 170 is made from a soft material so that the surface of the iron plate 170 can be easily attached to the trousers.

The iron plates 170 spray high-temperature steam or generate heat by using electricity. Preferably, steam sprayed from the iron plates 170 contain ozone or perfume therein. To this end, steam passes through an ozone generator (not shown) or a perfume generator (not shown) in the body 100 before steam is sprayed from the iron plates 170. The ozone generator makes ozone by using oxygen, and the perfume generator provides perfume to steam. The ozone generator and the perfume generator are generally known in the art and perfume or ozone can make contact with steam in various manners, so the detailed description thereof will be omitted below.

A fixing table 160 is provided at a lower front portion of the body 100 in order to fix a lower part of trousers thereto. The fixing table 160 can move up and down in order to fix various kinds of trousers including breeches thereto. The upward and downward movement of the fixing table 160 may be realized by employing a cylinder or rotating a screw using a motor. However, the present invention does not limit devices for moving the fixing table 160 up and down.

A pressing section 162 is provided at both sides of the fixing table 160 in such a manner that trouser legs are securely positioned between the pressing section 162 and the fixing table 160. The pressing section 162 can be manually or automatically operated.

The fixing table 160 is connected to a pneumatic cylinder 164 in order to move up and down. When treating knee trousers, such as breeches, the fixing table 160 moves up by means of the pneumatic cylinder 164. In addition, if the ironing device treats long trousers, the fixing table 160 moves down by means of the pneumatic cylinder 164. The position of the fixing table 160 can be adjusted by using a plurality of pedals 102 installed at a lower front portion of the body 100.

Figure 3:
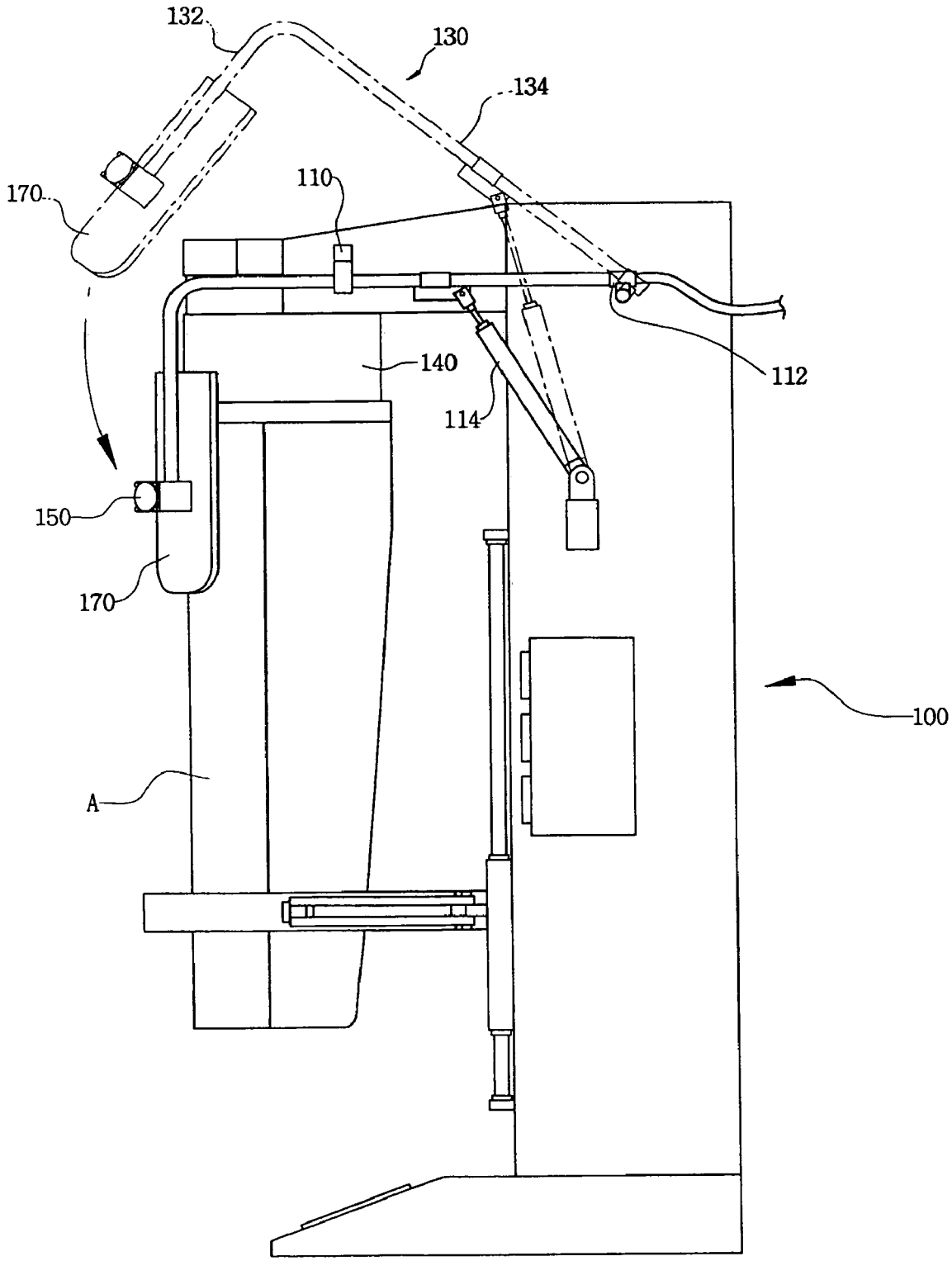
FIG. 3 is a side view showing a movement of an arm according to one embodiment of the present invention.

FIG. 3 is a side view showing a movement of the arm 130 according to one embodiment of the present invention. As shown in FIG. 3, the arm 130 is rotated about the rear supporting member 112 so that the horizontal arm 134 and the vertical arm 132 coupled to the horizontal arm 134 at a right angle are lifted in an upward direction.

The arm 130 has a simple structure as compared with a structure of the conventional arm 60 shown in FIG. 1. By means of the pneumatic cylinder 150 attached to the end of the vertical arm 132, the iron plates 170 make contact with the front top part of the trousers, thereby treating the front top part of the trousers.

After upwardly lifting the arms 130 by using the pneumatic cylinders 114 installed at both sides of the body 100, the trousers A are fixed to the trouser fixing member 140. In this state, the arms 130 are moved down so that the vertical arms 132 approach the front top part of the trousers A. At this time, the vertical arms 132 can make contact with the front top part of the trousers A. Then, the pneumatic cylinders 150 push the iron plates 170 towards the front top part of the trousers, so that the iron plates 170 create the clear creases in the front top part of the trousers.

Figure 4:
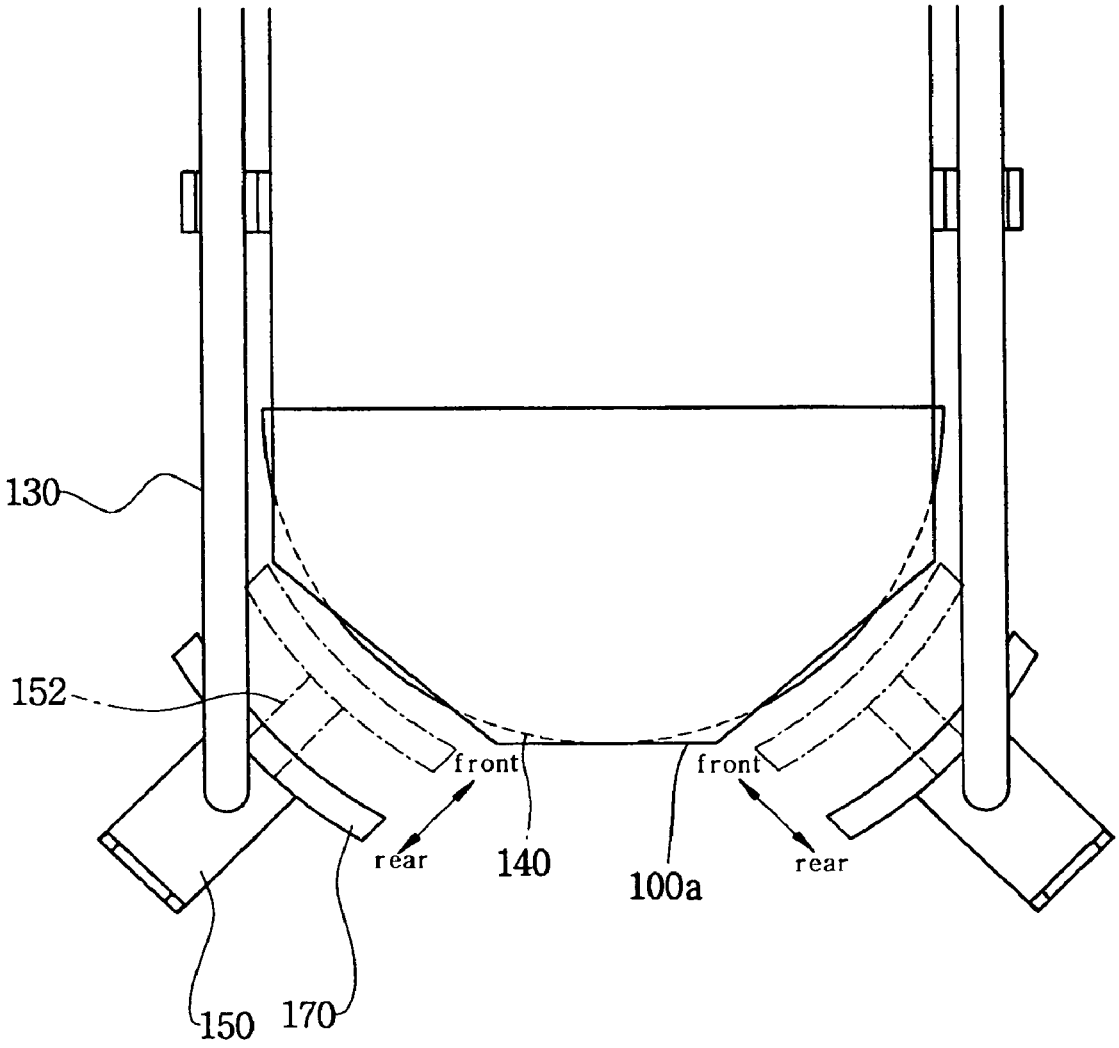
FIG. 4 is a plan view showing a movement of iron plates according to one embodiment of the present invention.

FIG. 4 is a plan view showing a movement of the iron plates 170 according to one embodiment of the present invention. Referring to FIG. 4, the iron plates 170 are moved in front and rear directions by means of pneumatic cylinders 150, which are coupled to the vertical arms 132 at a right angle.

The iron plates 170 may horizontally make contact with the trouser fixing member 140. Since the iron plates 170 do not rotate or slidably move with respect to the trousers, but press the trousers against the trouser fixing member 140, the shape of trousers or the crease formed in the trousers may not be deformed by the iron plates 170.

The iron plates 170 are coupled perpendicularly to the rods 152 and the pneumatic cylinders 150 receiving the rods 152 therein are coupled perpendicularly to the vertical arms 132. Due to such a coupling structure, the iron plates 170 may apply pressing force to the trousers in perpendicular to the surface of the trouser fixing member 140.

Figure 5:
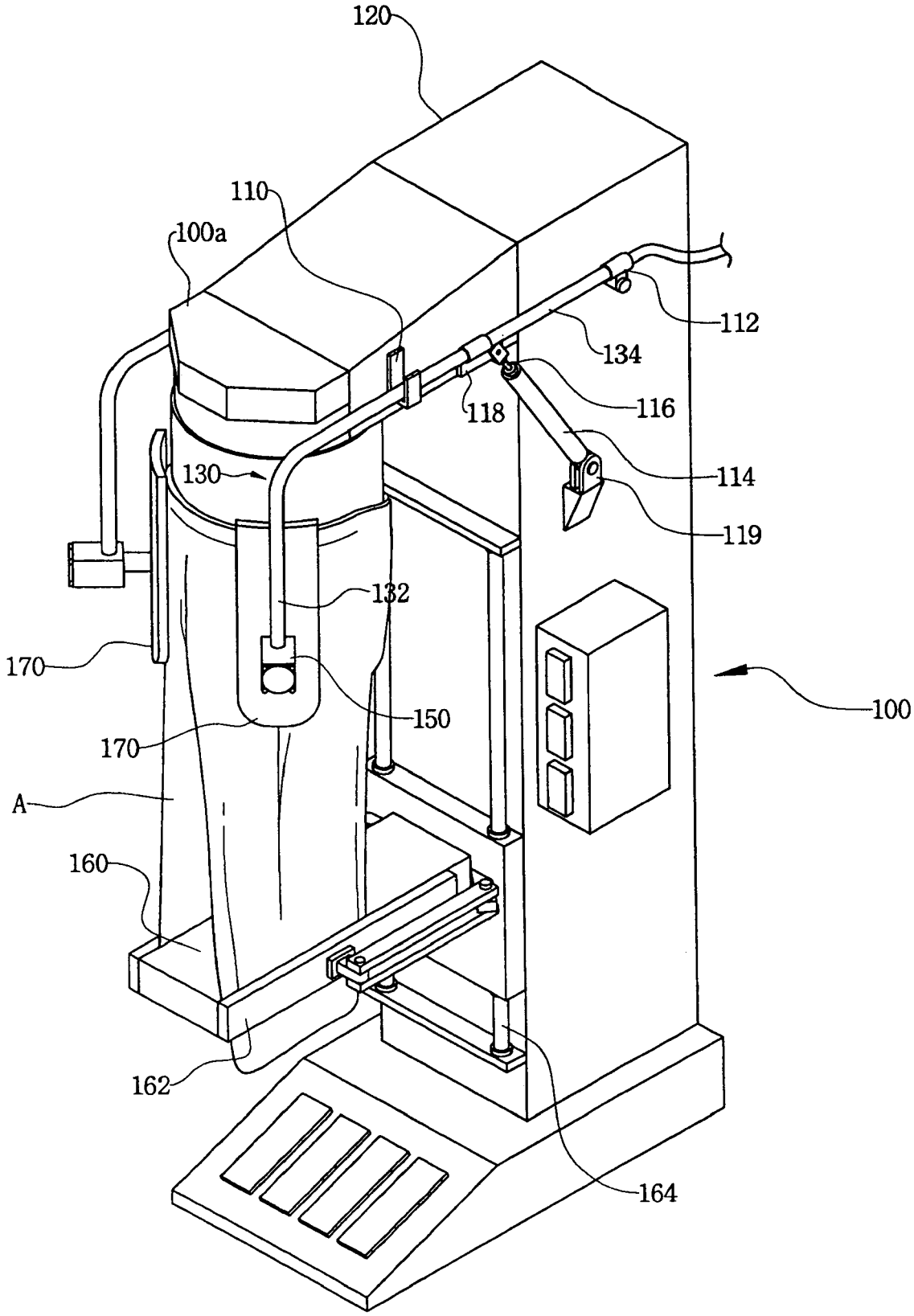
FIG. 5 is a perspective view showing an ironing device retaining trousers according to one embodiment of the present invention.

FIG. 5 is a perspective view showing the ironing device retaining trousers according to one embodiment of the present invention. Referring to FIG. 5, the top part of the trousers is securely aligned around the trouser fixing member 140 in such a manner that creases formed in the front top part of the trousers face the iron plates 170. The lower end portion of the trousers is securely fixed between the fixing table 160 and the pressing section 162.

In this state, the arms 130 are moved down by means of pneumatic cylinders 114 installed at both sides of the body 100 and the iron plates 170 are moved towards the front top part of the trousers by means of the pneumatic cylinders 150 installed at end portions of the vertical arms 132, so that pressing force is applied to the front top part of the trousers. Then, steam is sprayed from the trouser fixing member 140 and the iron plates 170. As mentioned above, steam has a high-temperature and contains ozone or perfume therein.

Since the iron plates 170 can simply press the trousers, the structure of the arms 130 for driving the iron plates 170 may be simplified. In addition, it is possible to make clear creases in the trousers.

Figure 6:
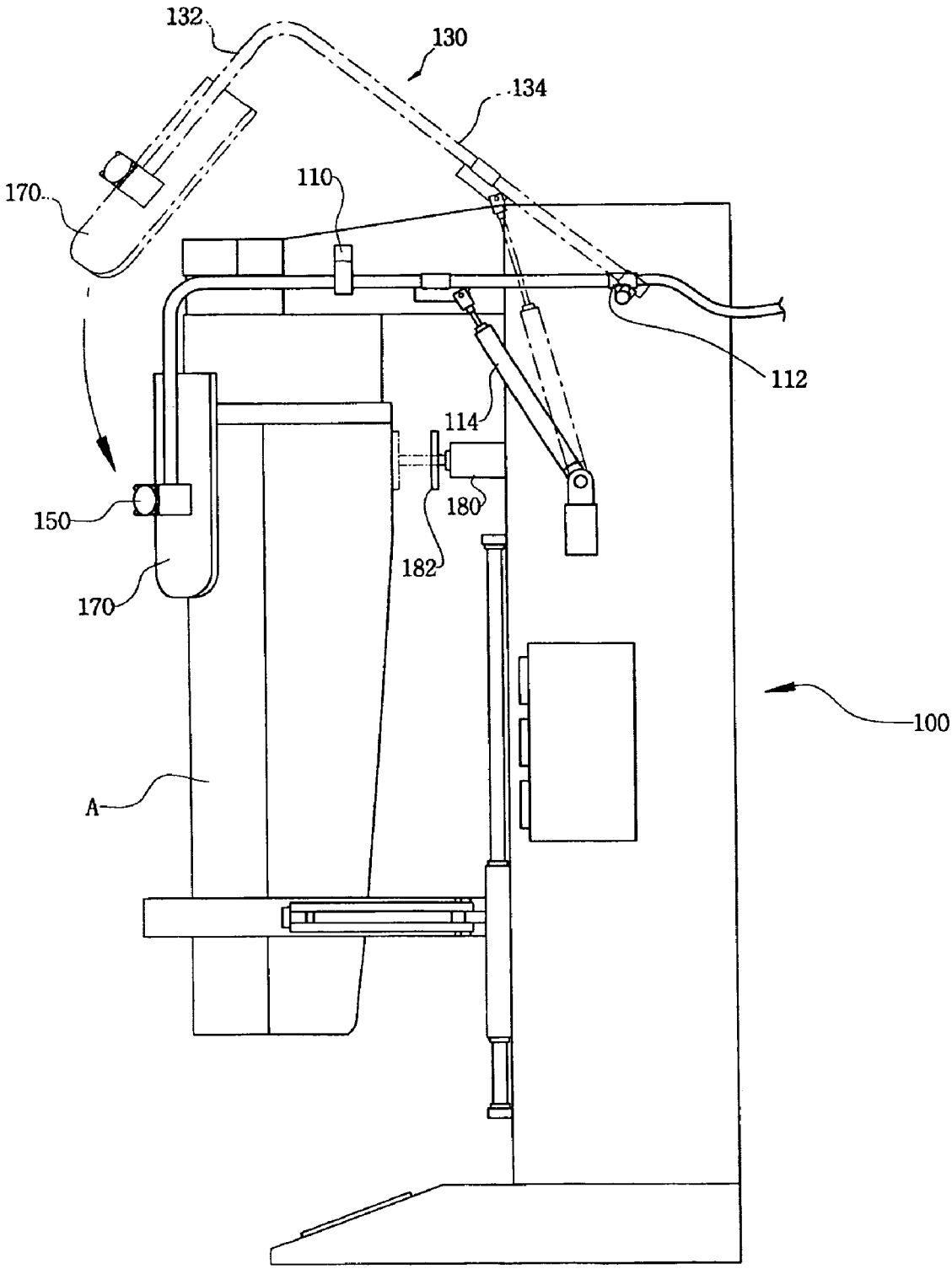
FIG. 6 is a side view showing a movement of a rear pressing plate according to one embodiment of the present invention.

FIG. 6 is a side view showing a movement of a rear pressing plate 182 according to one embodiment of the present invention. Referring to FIG. 6, the rear pressing plate 182 is positioned rearward of the trouser fixing member 140 so as to apply pressing force to a rear top part of the trousers.

When applying pressing force to creases formed in the front top part of the trousers in a state in which the trousers are attached to the trouser fixing member 140, wrinkles may be created in the rear top part of the trousers, that is, in a pocket area of the rear top part of the trousers. In order to iron out the wrinkles formed in the rear top part of the trousers, an additional pneumatic cylinder 180 is installed rearward of the trouser fixing member 140 and the rear pressing plate 182 is connected to the additional pneumatic cylinder 180 so as to press the rear top part of the trousers.

As described above, according to the present invention, the iron plates apply pressing force to the trousers in perpendicular to the front surface of the trousers without being rotated or slid with respect to the trousers, thereby forming clear creases in the trousers.

In addition, the present invention does not require a complicate structure for rotating the arms, so the ironing device of the present invention has a simple structure while reducing power consumption.

Since ozone or perfume is added to steam sprayed from the iron plates, an ironing process can be carried out with a fragrant odor while sterilizing the trousers.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An ironing device for treating a front top part of trousers, the ironing device, comprising:

a body including a trouser fixing member formed below a front protrusion of an upper supporter and an iron plate, which is movable towards the trouser fixing member in such a manner that the iron plate makes contact with the trousers while applying steam or heat to the trousers so as to create clear creases in the front top part of the trousers;

front and rear supporting members formed at both sides of the front protrusion;

an arm including a vertical arm and a horizontal arm coupled to the vertical arm at a right angle and horizontally installed in the front and rear supporting members; and a first pneumatic cylinder coupled perpendicularly to an end of the vertical arm and having a rod coupled perpendicularly to a bottom surface of the iron plate so as to move the iron plate in front and rear directions.

2. The ironing device as claimed in claim 1, wherein upper portions of the front and rear supporting members are opened, the rear supporting member rotatably supports an end portion of the horizontal arm, and a second pneumatic cylinder coupled to a side of the body is connected to the horizontal arm.

3. The ironing device as claimed in claim 1, wherein a steam spraying section is provided in the trouser fixing member in order to spray steam onto the trousers.

4. The ironing device as claimed in claim 1, wherein a fixing table, which is movable up and down, is provided at a lower portion of the body in order to fix a lower end portion of the trousers thereto.

5. The ironing device as claimed in claim 1, further comprising a rear pressing plate and a second pneumatic cylinder provided rearward of the trouser fixing member so as to apply pressing force to a rear top part of the trousers.

6. The ironing device as claimed in claim 3, wherein steam sprayed from the steam spraying section passes through an ozone generator or a perfume generator in the body of the ironing device so as to contain ozone or perfume therein.

* * * * *